US005127175A

United States Patent [19]

Atkinson

[11] Patent Number: 5,127,175

[45] Date of Patent: Jul. 7, 1992

[54] SNOW PLOW SUPPORT DEVICE

[76] Inventor: Mitch Atkinson, 1518 Atkinson Rd., Dixon, Ill. 61021

[21] Appl. No.: 727,874

[22] Filed: Jul. 10, 1991

[51] Int. Cl.[5] ..... E01H 5/06

[52] U.S. Cl. ..... 37/270; 37/232; 403/135; 403/143

[58] Field of Search ..... 37/266, 270, 271, 232; 403/135, 143

[56] References Cited

U.S. PATENT DOCUMENTS

| | | | |
|---|---|---|---|
| 1,686,243 | 10/1928 | Meyer | 37/271 |
| 1,730,817 | 10/1929 | Gyllenkrook | 37/271 |
| 1,739,352 | 12/1929 | Choate | 37/270 X |
| 2,507,108 | 5/1950 | Lange | 403/143 X |
| 3,464,129 | 9/1969 | Bogenschulz | 37/270 X |
| 4,679,959 | 7/1987 | Cavalloro | 403/143 |
| 4,778,196 | 10/1988 | Spoliansky | 403/143 X |

*Primary Examiner*—Randolph A. Reese
*Assistant Examiner*—Arlen L. Olsen
*Attorney, Agent, or Firm*—Douglas B. White

[57] ABSTRACT

A swivel design for a wear shoe is described which provides support to apparatus cantilevered from a vehicle. This effectively reduces wear to the contacting surface by distributing the wear more evenly. To accomplish this objective the wear shoe is mounted to the supported structure by a swivel joint which allows full freedom of movement. During use the wear shoe tilts and rotates on the swivel to maintain the wear surface of the shoe in facing relation to the road surface.

3 Claims, 2 Drawing Sheets

SNOW PLOW SUPPORT DEVICE

BACKGROUND OF THE INVENTION

1. Field of the Invention

The present invention relates generally to devices used to assist in the support of structures, such as snow plows or the like, which are mounted to vehicles. More particularly this invention relates to devices known as support runners and drag shoes which are affixed to the underside of such structures.

2. Description of the Prior Art

Snow plows and similar apparatus are typically cantilevered from the chassis of a vehicle. Runners, wear shoes and wheels have been used to provide support for the overhanging extremity of the structure and to maintain the apparatus at a preset elevation over the road surface. While prior wear resistant support devices have achieved limited success, excessive wear and premature failure have remained a dangerous problem. Use of wheels has proven to be unstable and similarly subject to excessive wear and premature failure.

SUMMARY OF THE INVENTION

It is accordingly the principal object of the present invention to provide a safer wear shoe for snow plows and the like which effectively reduces wear to the contacting surface and distributes wear more evenly. This is accomplished in the preferred embodiment by providing a wear shoe which presents a wear surface to the road and provides continuous automatic alignment to present the wear surface tangentially against the road surface. In the preferred embodiment this wear shoe presents a generally spherically shaped surface, having sides chamfered inwardly toward the contacting surface. Most importantly, this shoe is mounted to the supported structure by a swivel joint which allows full freedom of movement. During use the wear shoe is allowed to tilt and rotate on the swivel to minimize wear on the contacting surface.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
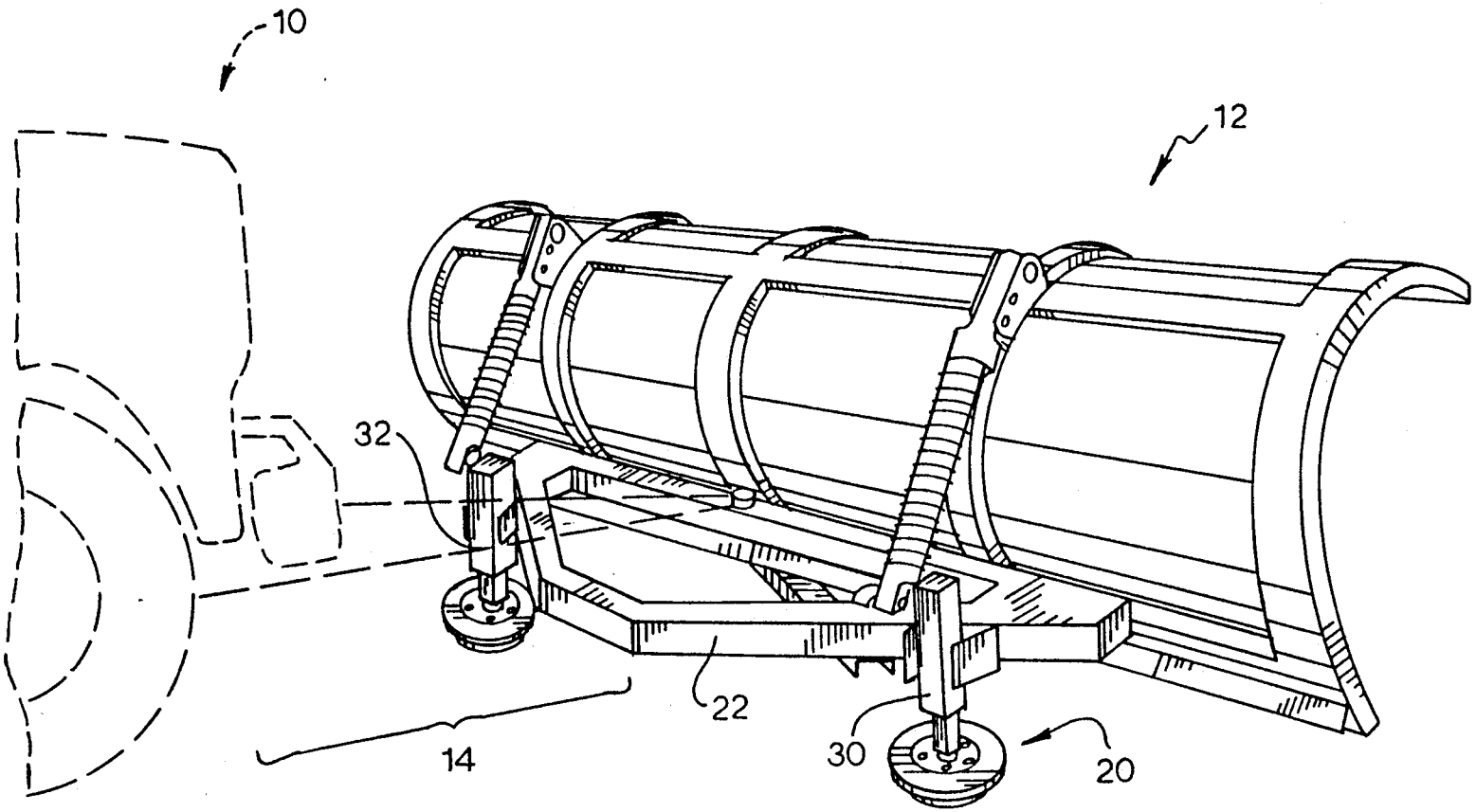
FIG. 1 is a perspective view of a snow plow employing the wear shoes of the present invention.

Turning first to FIG. 1 there is shown a vehicle 10 having a plow 12 cantilevered to the vehicle 10 via supports 14 shown in phantom. Further supporting the plow, in accordance with the present invention, are wear shoes 20 shown affixed to the plow support bracket 22. During use of the plow, the wear shoes ride on the road surface to thereby position and support the plow at a pre-selected elevation above the road surface. This elevational positioning of the plow is accomplished by adjusting means at the mounting posts 30 and 32; and such adjustment may take the form of a screw thread, a hand crank, or any other device or method commonly known in the art.

Figure 2:
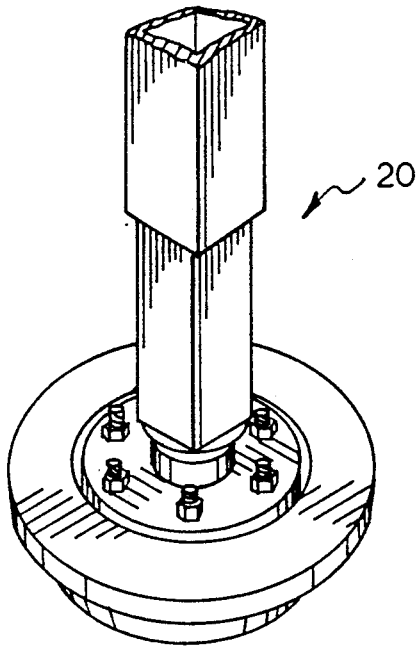
FIG. 2 is a perspective view of a wear shoe of FIG. 1.
Figure 3:
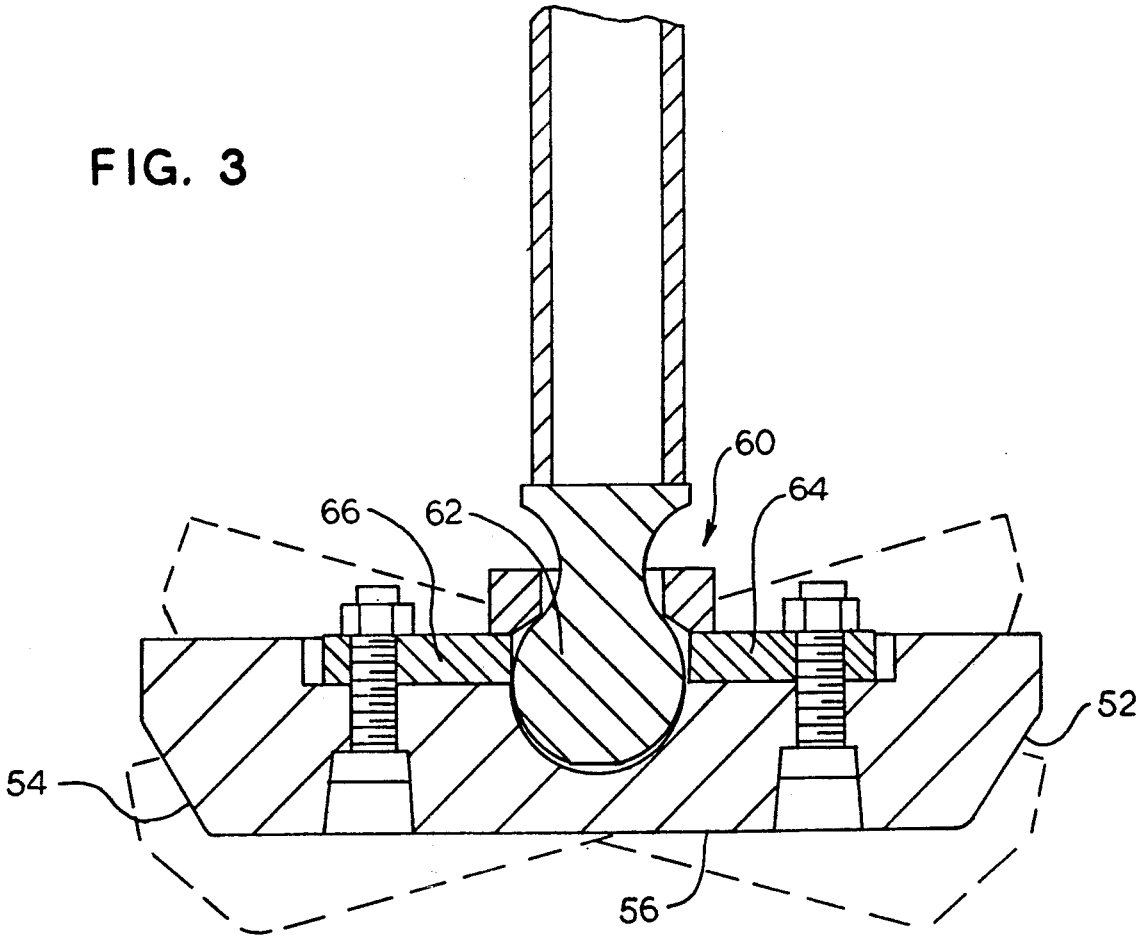
FIG. 3 is a cross sectional view of the wear shoe depicted in FIG. 2, showing (in phantom) the tilting and swiveling motion of the shoe.

In the preferred embodiment, the wear shoe 20 presents a generally spherical shape (FIG. 2) to the road surface; and in the preferred embodiment shown in FIG. 3, it exhibits chamfered sides 52 and 54 and a generally flattened bottom face 56. Securing the shoe to the mounting post is a swivel joint 60 comprising a ball 62 mounted into a socket formed in the shoe. And the ball is held into the socket by removable plates 64 and 66 which are bolted to the shoe.

During use, the contacting surface 56 of the wear shoe rides against and faces the road surface; and due to the swivel joint, the shoe is allowed to "tilt" in all directions to constantly maintain the wear surface of the shoe in facing relation against the road surface. Concentration of wear on a limited portion of the shoe is avoided and the life of the shoe is thereby extended. The chamfered sides of the shoe which produce the spherical nature of its shape facilitate use on rough roads and allow the shoe to "ride over" small bumps.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A wear shoe for a snow plow being moved in controlled proximity to the road surface comprising:

a replaceable surface contacting member having an upper mounting portion and a lower wear surface portion, wherein sides of said surface contacting member converge toward lower extremity;

mounting means for securing said surface contacting member to said snow plow; and swivel joint means releasably contained within said surface contacting member for attaching said surface contacting member to said mounting means for allowing said surface contacting member to freely adjust position in conformity with the traversed road surface and to allow free rotation about said swivel joint means.

2. A wear shoe for a snow plow being moved in controlled proximity to a road surface of claim 1 wherein said swivel joint means comprises a ball and a socket joint.

3. A wear shoe for a snow plow being moved in controlled proximity to a road surface of claim 2 wherein said ball is held into said socket by removable cover plates.

* * * * *